United States Patent [19]

Johnson et al.

[11] Patent Number: 4,737,135

[45] Date of Patent: Apr. 12, 1988

[54] TOY WITH SPRING-LOADED INNER VEHICLE

[75] Inventors: Robert W. Johnson, Hennepin County, Minn.; Tak-Ko Wong, North Point, Hong Kong

[73] Assignee: Girsch Design Associates, St. Paul, Minn.

[21] Appl. No.: 905,471

[22] Filed: Sep. 10, 1986

[51] Int. Cl.[4] ..... A63H 17/00

[52] U.S. Cl. ..... 446/430; 446/435

[58] Field of Search ..... 446/432, 430, 457

[56] References Cited

U.S. PATENT DOCUMENTS

| | | | |
|---|---|---|---|
| 4,345,402 | 8/1982 | Hanson et al. | 446/430 |
| 4,464,860 | 8/1984 | Onodera | 446/435 X |
| 4,504,239 | 3/1985 | Kalesza et al. | 446/435 X |

*Primary Examiner*—Kenneth J. Dorner
*Assistant Examiner*—Gerald Anderson

[57] ABSTRACT

A toy is disclosed having a spring-loaded inner vehicle or projectile therewithin. An outer shell surrounds the inner vehicle, and the outer shell has a base at one end thereof constituting the rear of the shell. A spring is interposed between the inner vehicle and the base for resiliently biasing the inner vehicle away from the base in a forward direction. The outer shell has a portion thereof movable with respect to the base between a closed position in which the outer shell at least in part encloses the inner vehicle and holds the inner vehicle fixed with respect to the base while maintaining the spring in its compressed state, and an open position in which the shell portion is clear of the inner vehicle such that the spring may propel the inner vehicle forwardly with respect to the base portion.

9 Claims, 1 Drawing Sheet

TOY WITH SPRING-LOADED INNER VEHICLE

BACKGROUND OF THE INVENTION

This invention relates to a toy with a spring-loaded inner vehicle. More specifically, this invention relates to an outer shell which is hinged relative to a base portion for pivotal movement between an opened and a closed position. An inner vehicle (or projectile) is enclosed within the outer shell when the latter is in its closed position such that upon opening of the outer shell, the inner vehicle is propelled forwardly by a spring.

SUMMARY OF THE INVENTION

Among the several objects and features of the present invention may be noted the provision of a toy with a spring-loaded inner vehicle in which an outer shell encloses the inner vehicle, and in which, upon manually squeezing or pinching the rear of the outer shell, the outer shell opens thereby to release the inner vehicle which is propelled in forward direction relative to the outer shell;

The provision of such a toy in which the movable outer shell portions open in unison with one another thereby to ensure a proper release of the inner vehicle only when all portions of the outer shell are clear of the inner vehicle;

The provision of such a toy in which the inner vehicle has wheels and in which the outer shell and inner toy vehicle are rollingly supported on the wheels, with the outer shell configured to be a vehicle body such that the assembled shell and inner vehicle have the visual appearance of a single vehicle;

The provision of such a toy in which the outer shell has one or more transverse partitions therein engageable with the inner toy vehicle for holding the inner toy vehicle in place relative to the outer shell while the movable shell portions are opened thereby to effect the instantaneous release of the inner vehicle only when the partitions are moved clear of the inner vehicle; and The provision of such a toy which is of rugged and economical construction, and which may be made in a variety of configurations (i.e., different shapes of outer shells and inner vehicles).

Other objects and features of this invention will be in part apparent and in part pointed out hereinafter.

Briefly stated, a toy of the present invention comprises an inner vehicle and an outer shell surrounding the inner vehicle. The outer shell has a base at one end thereof constituting the rear end of the shell. A spring is interposed between the inner vehicle and the base for resiliently biasing the inner vehicle away from the base in forward direction. The outer shell has a portion thereof movable with respect to the base between a closed position in which the outer shell, at least in part, encloses the inner vehicle and holds the inner vehicle fixed with respect to the base while maintaining the spring in its compressed state, and an open position in which the shell portion is clear of the inner vehicle such that the spring may propel the inner vehicle forwardly with respect to the base portion.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
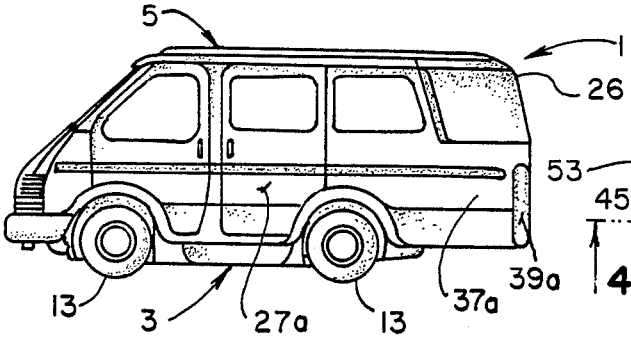
FIG. 1 is a side elevational view of a toy of the present invention having an outer shell configured in the shape of a van enclosing a spring-loaded inner vehicle configured as a sports car, with the outer vehicle or shell being rollingly supported by the wheels of the inner vehicle.

Referring now to the drawings, a toy of the present invention is indicated in its entirety at reference character 1. More specifically, toy 1 comprises an inner vehicle or projectile 3 at least partially enclosed within an outer shell 5. As illustrated, the inner vehicle 3 is in the form of a sports car and the outer shell 5 is in the form of a van. However, within the broader aspects of this invention, both the inner vehicle and outer shell may take on a variety of other forms.

The inner vehicle 3 comprises a chassis or frame 7 having a front axle 9 and a rear axle 11 on which wheels 13 are rotatably mounted such that the inner vehicle 3 is rollingly supported on wheels 13. The inner vehicle further includes a body 15 mounted on chassis 7. The body 15 has windows 17 therein. As indicated at 23, a front bumper is carried by inner vehicle body 15 for purposes as will appear.

In accordance with this invention, spring propulsion means, as generally indicated at 18, is provided within inner vehicle or projectile 3 for propelling the inner vehicle in forward direction relative to the outer shell in a manner as will hereinafter appear. More specifically, spring propulsion means 18 comprises a hollow spring tube 19 mounted within inner car body 15 and extending longitudinally thereof. The car body has an opening 20 in the rear thereof in register with spring tube 19. A compression coil spring 21 is disposed within spring tube 19 at the forward end thereof.

Figure 4:
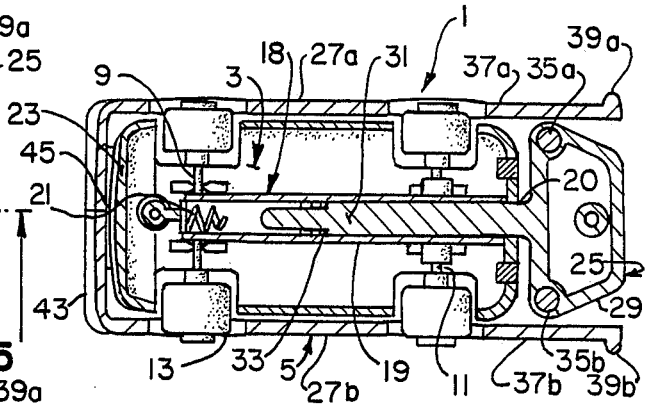
FIG. 4 is a horizontal cross sectional view taken along line 4—4 of FIG. 2, illustrating details of construction of the shell, of the inner vehicle, and for the spring utilized to propel the inner vehicle forwardly with respect to the shell.
Figure 5:
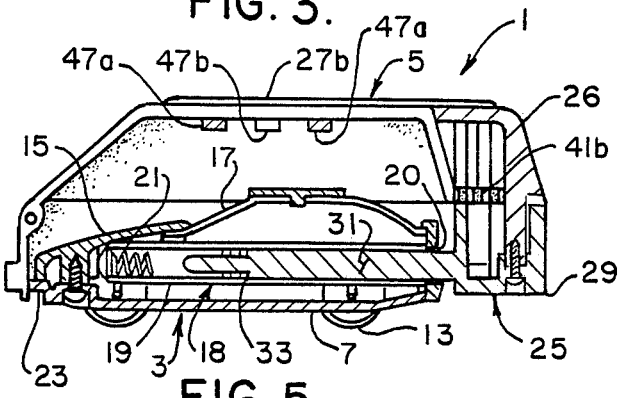
FIG. 5 is a vertical cross sectional view, taken along line 5—5 of FIG. 3.
Figure 8:
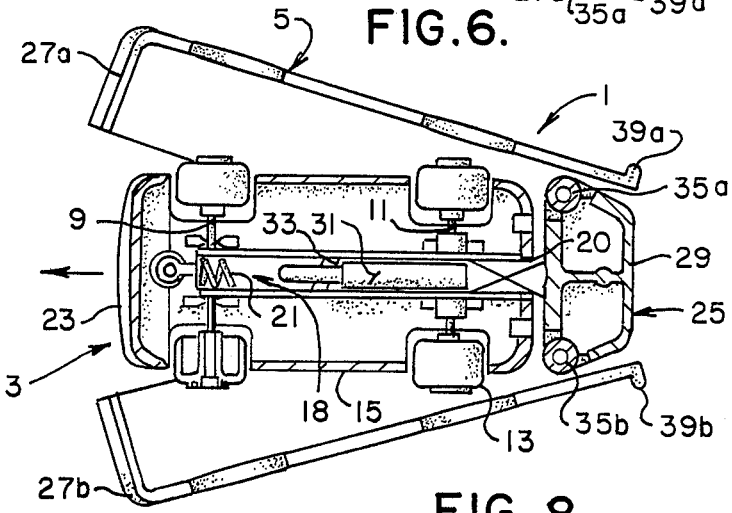
FIG. 8 is a view similar to FIG. 4, illustrating the shell portions in their respective open position thereby to allow the compressed spring interposed between the inner vehicle and the outer shell to propel the inner vehicle forwardly with respect to the shell.

Outer shell 5 is shown to comprise a base 25 having a base cover 26 mounted thereon on top of the base. Shell 5 is shown to be split longitudinally defining a pair of outer shell covers or portions **27*a*, 27*b* which are pivotally mounted to base 25**. The shell portions are for pivotally moving between a closed position, as shown in FIG. 4, in which shell covers or portions 27*a*, 27*b* and base 25 at least partially enclose the inner vehicle 3, and an open position, as shown in FIG. 8, in which the shell portions 27*a*, 27*b* are clear of the inner vehicle 3, thus permitting spring propulsion means 18 to propel the inner vehicle in forward direction relative to base 25, as indicated by the arrow in FIG. 8.

More specifically, base 25 includes a base body 29 located at the rear of the outer shell 5. A spring compression rod or shaft 31 extends forwardly from base body 29. A spring abutment shoulder 33 is provided on the outer end of spring compression rod 31. It will be appreciated that with outer shell portions 27*a*, 27*b* in their open position, as shown in FIG. 8, the user of toy 1 may insert the outer end of spring compression rod 31 into the opening 20 at the rear of inner vehicle 3. As the inner vehicle is moved rearwardly toward base body 29, spring abutment shoulder 33 on the spring compression rod 31 engages the outer end of spring 21 and compresses the spring. With the rear of the inner vehicle in close proximity to base body 29, as shown in FIG. 8, outer shell portions 27*a*, 27*b* may be pivotally moved from their open position, as shown in FIG. 8, to their closed position, as shown in FIG. 4, wherein the inner surfaces of the forward ends of the outer shell portions 27*a*, 27*b* engage the front bumper 23 of inner vehicle 3 and thus positively hold the inner vehicle 3 within outer shell 5 with spring propulsion means 18 remaining in its compressed state.

Figure 6:
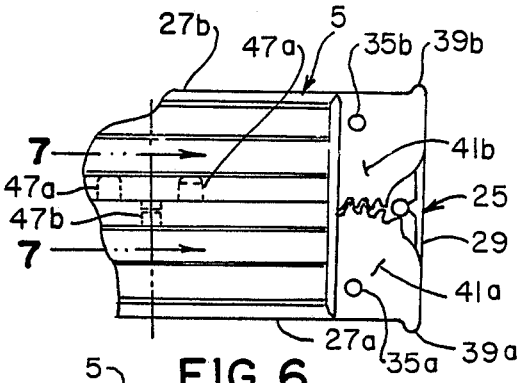
FIG. 6 is top plan view of the rear portion of the toy shown in FIG. 1, with the base cover at the rear of the shell being removed for illustrating a pair of gear segments in mesh with one another, with the gear segments being journalled on the base and being movable with portions of the shell thereby to ensure that the shell portions open in unison with one another.

As heretofore noted, outer shell portions 27*a*, 27*b* are pivotally attached by pivots 35*a*, 35*b* to base body 29. Pivot points 35*a*, 35*b* are spaced apart from one another on opposite sides of the longitudinal centerline of the outer shell. The outer shell portions 27*a*, 27*b* have respective extensions 37*a*, 37*b* extending rearwardly relative to pivot points 35*a*, 35*b*. Each of these outer shell extensions has a respective finger fulcrum 39*a*, 39*b* on the rear end thereof. Further in accordance with this invention, each of the outer shell portions 27*a*, 27*b* carries a respective gear segment 41*a*, 41*b*, as shown in FIG. 6, which are in mesh with one another and which constitute linkage means for ensuring that the outer shell portions 27*a*, 27*b* open and close in unison with one another.

Thus, in operation, with the inner vehicle 3 installed within outer shell 5, with the spring propulsion means 18 compressed in the manner heretofore described, the user of toy vehicle 1 of the present invention may effect opening of the outer shell by placing his thumb and forefinger on finger fulcrums 39*a*, 39*b* and squeezing or pinching the finger fulcrums inwardly toward the base body 29. As is best shown in FIGS. 4 and 8, the rear sides of the base body 29 angle inwardly toward the rear of the vehicle. Upon pinching or squeezing the outer shell rear extensions 37*a*, 37*b*, the outer shell portions 27*a*, 27*b* which are split longitudinally of the vehicle, move from their closed position, as shown in FIG. 4, to their open position, as shown in FIG. 8, in which position the outer shell portions are moved clear of the inner vehicle, thus permitting the spring propulsion means 18 to propel the inner vehicle forwardly (as shown by the arrow in FIG. 8) away from the outer shell. Gear segments 41*a*, 41*b*, which are rotatable with their respective shell portions 27*a*, 27*b* and which are in mesh with one another, ensure that both of the shell portions open the same amount, regardless of whether more squeezing force is applied to one or the other of the rear extensions 37*a*, 37*b* of the shell portions.

Outer shell portions 27*a*, 27*b* have a bumper abutment section 43 on the inner face of the forward ends thereof adapted to engage the front bumper 23 of the inner vehicle. Preferably, but not required, the bumper abutments 43 are provided with a high friction surface 45 (e.g., serrations molded on the bumper abutment portions) for engaging the front bumper 23 of the inner vehicle, and for withstanding the resilient force applied thereto by the bumper 29 of the inner vehicle 3 which is urged forward by spring 21 and for at least initially resisting opening of the outer shell portions 27*a*, 27*b*.

Figure 7:
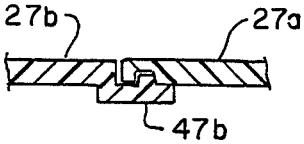
FIG. 7 is an enlarged cross sectional view, taken along line 7—7 of FIG. 6, illustrating a latch for holding the shell portions in their closed positions.

Additionally, optional latching tabs 47*a*, 47*b* may be provided on the roof sections of the respective outer shell portions 27*a*, 27*b* for cooperating with one another so as to latch the outer shell portions together in their closed positions. More specifically, this outer shell latching means is shown to comprise a groove 49 provided in outer shell portion 27*a*, as illustrated in FIG. 7. A shoulder 51 is provided on latching tab 47*b* so as to be received within groove 49. In this manner, with the outer shell portions 27*a*, 27*b* in their closed position (FIG. 4), the latching tabs 47*a*, 47*b* cooperate with their mating outer shell portions to lock the outer shell portions together so as to surround the inner vehicle. Thus, during play with the toy vehicle, the outer shell portions will positively remain closed around the inner vehicle. However, upon squeezing or pinching forces being applied to the finger fulcrums 39*a*, 39*b*, the squeezing action will readily overcome the latching action of latching tabs 47*a*, 47*b*, and will also readily overcome the friction of the bumper abutments 43 on the front bumper 23 of the inner vehicle, thus permitting the outer shell portions 27*a*, 27*b* to move to their open positions.

Figure 2:
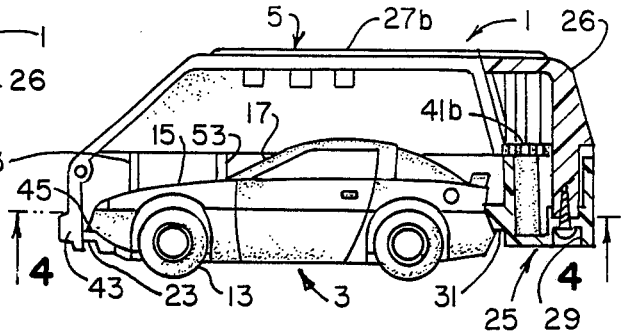
FIG. 2 is a longitudinal vertical cross section of the toy shown in FIG. 1 illustrating the inner vehicle and portions of the shell enclosing the inner vehicle.
Figure 3:
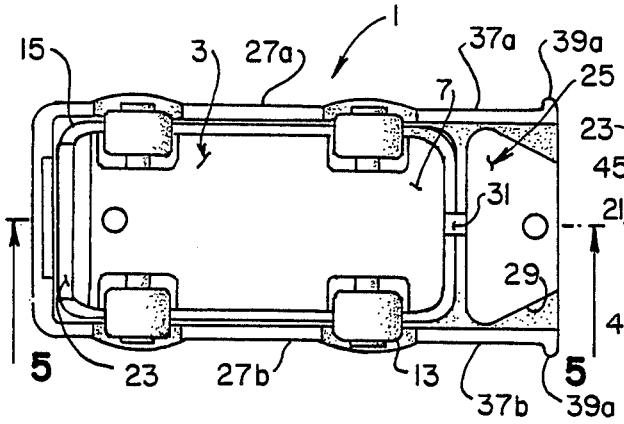
FIG. 3 is a bottom plan view of FIG. 1.

Still further in accordance with this invention, transverse inner vehicle engaging fingers or partitions 53 may be provided within each of the outer shell portions 27*a*, 27*b*, as shown in FIG. 2, so as to engage inner vehicle 3 at predetermined locations thereon. These transverse partitions 33 bear on predetermined surfaces on the inner vehicle so as to hold the inner vehicle in a predetermined position with respect to base 25, thus maintaining spring 21 in its fully compressed state as the outer shell portions 27*a*, 27*b* are moved from their fully opened positions, as shown in FIG. 8, toward their closed position prior to bumper abutments 43 engaging front bumper 23. Additionally, upon beginning opening movement of the shell portions, it will be appreciated that the transverse partitions 53 remain in engagement with car body 15 at their respective predetermined locations thereon, thus holding the inner vehicle in substantially fixed relation with respect to base 25, even as the bumper abutment sections 43 of the outer shell portions 27*a*, 27*b* move laterally outwardly and clear of front bumper 23 without permitting any substantial forward movement of the inner vehicle until such time as the outer shell portions 27*a*, 27*b* together with partitions 53 are moved fully clear of the inner vehicle. Thus, only when the outer shell portions 27*a*, 27*b* are in their nearly fully opened position, as shown in FIG. 8, will the inner vehicle be permitted to be moved forwardly with respect to the outer shell 5 by spring 21.

In accordance with this invention, it will be understood that the outer shell 5 may be provided with wheels (not shown), rather than being rollingly supported on wheels 13 of inner vehicle 3, as shown herein. It will also be understood that within the broader aspects of this invention, the outer shell 5 may take on any desired shape, as may the inner vehicle 3. For example, within the broader aspects of this invention, the outer shell may be in the form of a military tank, and the inner vehicle may be a motorcycle or the like. Still further, the outer shell 5 may be an airplane, and the inner vehicle or projectile 3 may be a missile which is "launched" upon effecting opening of the outer shell. Within the broader aspects of this invention, the term "vehicle" is not limited to vehicles having wheels.

Still further in accordance with this invention, while outer shell portions 27*a*, 27*b* have herein been shown as being pivotally attached to base body 29 by pivots 35*a*, 35*b* for pivoting movement about vertically disposed axes, it will also be understood that, within the broader aspects of this invention, the outer shell portion or portions may be pivoted relative to base body 29 in such manner as to rotate vertically about a horizontal axis.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. A toy comprising an inner vehicle and an outer shell at least in part surrounding said inner vehicle, said shell having a base at one end thereof constituting the rear end of said shell, a spring interposed between said inner vehicle and said base for resiliently biasing said inner vehicle away from said base in a forward direction, said outer shell having a portion movable with respect to said base between a closed position in which said shell at least in part encloses said inner vehicle and holds said inner vehicle fixed with respect to said base while maintaining said spring in its compressed state, and an open position in which said shell portion is clear of said inner vehicle such that said spring may propel said inner vehicle forwardly with respect to said base, said inner vehicle having a longitudinally extending tube therein, said tube being open at the rear of said inner vehicle, said spring being disposed within said tube, said base having a rod extending therefrom, said rod being received within said tube and being engageable with said spring for compressing said spring as said inner car is moved rearwardly toward said base, said shell portion is split longitudinally into a pair of shell covers, with each shell cover being pivotally connected to said base for rotating in a horizontal plane about a respective vertical axis relataive to said base.

2. A toy as set forth in claim 1 wherein each of said shell covers has at least one transversely extending inner partition engageable with said inner vehicle for holding said inner vehicle in fixed position relative to said base as said shell covers are moved from their closed to their open position until such time as the shell covers are clear of said inner vehicle, such that when said partitions move clear of said inner vehicle, said inner vehicle is free to be propelled forwardly by said spring.

3. A toy comprising an inner vehicle and an outer shell at least in part surrounding said inner vehicle, said shell having a base at one end thereof constituting the rear end of said shell, a spring interposed between said inner vehicle and said base for resiliently biasing said inner vehicle away from said base in a forward direction, said outer shell having a portion movable with respect to said base between a closed position in which said shell at least in part encloses said inner vehicle and holds said inner vehicle fixed with respect to said base while maintaining said spring in its compressed state, and an open position in which said shell portion is clear of said inner vehicle such that said spring may propel said inner vehicle forwardly with respect to said base, said shell including a pair of shell covers, each of said shell covers being pivotally connected to said base at a respective pivot point, with said pivot points being spaced from one another, and linkage means interconnecting said shell covers to one another for ensuring that said shell covers move with one another in unison between their closed and open positions.

4. A toy as set forth in claim 3 wherein said inner vehicle has a plurality of wheels, and wherein, with said outer shell enclosing said inner vehicle, said outer shell and said inner vehicle are rollingly supported on said wheels.

5. A toy as set forth in claim 3 wherein said inner vehicle has a longitudinally extending tube therein, said tube being open at the rear of said inner vehicle, said spring being disposed within said tube, said base of said outer shell having a rod extending therefrom, said rod being received within said tube and being engageable with said spring for compressing said spring as said inner car is moved rearwardly toward said base.

6. A toy as set forth in claim 3 wherein said linkage means comprises a gear segment carried by each of said shell covers, with said gear segments being in mesh with one another.

7. A toy as set forth in claim 6 wherein each of said gear segments is rotatable about said pivot for its respective shell cover.

8. A toy as set forth in claim 3 wherein each shell cover has a portion thereof constituting an extension which extends rearwardly of said pivot point such that upon squeezing inwardly on said rear portions of each of said shell covers effects movement of said shell covers from said closed to said open position.

9. A toy as set forth in claim 8 wherein each said extension has a finger fulcrum thereon for aiding in the manual application of squeezing forces on said extensions so as to effect opening of said shell covers.

* * * * *